US007064499B2

(12) United States Patent
Lott

(10) Patent No.: US 7,064,499 B2
(45) Date of Patent: Jun. 20, 2006

(54) METHOD FOR OPERATING AT LEAST ONE LOW-PRESSURE DISCHARGE LAMP AND OPERATING DEVICE FOR AT LEAST ONE LOW-PRESSURE DISCHARGE LAMP

(75) Inventor: Jörg Lott, Chieming (DE)

(73) Assignee: Patent Treuhand Gesellschaft fur elektrische Gluhlampen mbH, Munich (DE)

( * ) Notice: Subject to any disclaimer, the term of this patent is extended or adjusted under 35 U.S.C. 154(b) by 0 days.

(21) Appl. No.: 10/832,260

(22) Filed: Apr. 27, 2004

(65) Prior Publication Data

US 2004/0263096 A1 Dec. 30, 2004

(30) Foreign Application Priority Data

Jun. 25, 2003 (DE) ..... 103 28 718

(51) Int. Cl.
*G05F 1/00* (2006.01)

(52) U.S. Cl. ..... 315/291; 315/307; 315/312; 363/132

(58) Field of Classification Search ..... 315/224, 315/237, 312, 313, 291, 307; 363/132
See application file for complete search history.

(56) References Cited

U.S. PATENT DOCUMENTS 4,117,400 A * 9/1978 Feldman ..... 324/765
5,359,274 A * 10/1994 Bandel ..... 323/207
5,569,984 A * 10/1996 Holtslag ..... 315/307
5,623,187 A * 4/1997 Caldeira et al. ..... 315/307
6,198,231 B1 3/2001 Schemmel et al. ..... 315/209 R
6,232,727 B1 5/2001 Chee et al. ..... 315/307
6,794,828 B1 * 9/2004 Tyson ..... 315/244

FOREIGN PATENT DOCUMENTS

WO WO 99/56506 11/1999

OTHER PUBLICATIONS

European Patent Office Search Report (referencing document listed above) dated Nov. 2004.

* cited by examiner

*Primary Examiner*—Wilson Lee
*Assistant Examiner*—Jimmy Vu

(57) ABSTRACT

The invention relates to a method for operating at least one low-pressure discharge lamp using an inverter, during the operation of the at least one low-pressure discharge lamp the occurrence of a rectifier effect in the at least one low-pressure discharge lamp being monitored in order to determine the end of its life. For the purpose of monitoring the rectifier effect of the at least one low-pressure discharge lamp, the DC voltage drop across the electrical connections of the at least one low-pressure discharge lamp and the current through the at least one low-pressure discharge lamp are evaluated.

6 Claims, 2 Drawing Sheets

Figure 1:
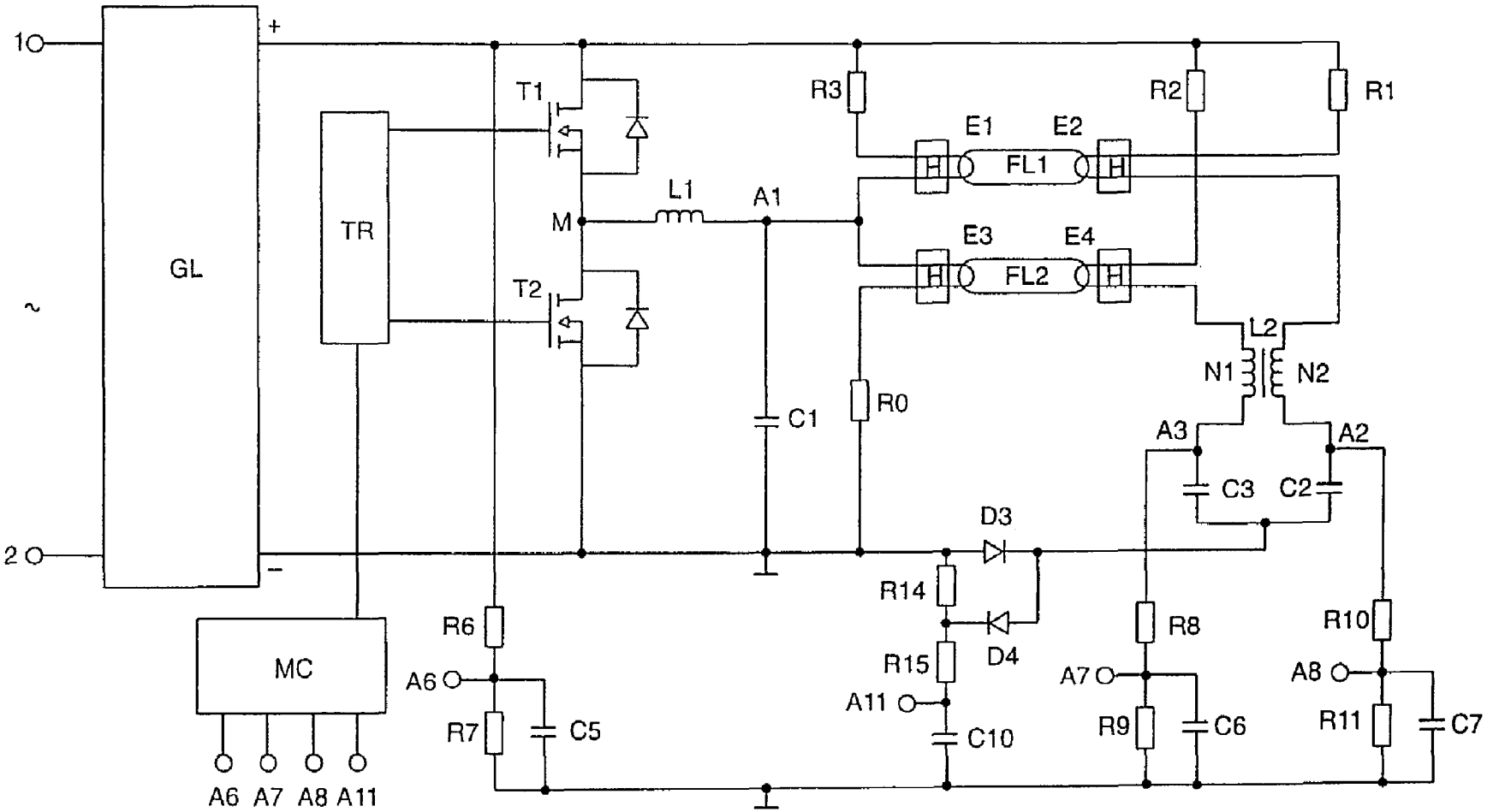

METHOD FOR OPERATING AT LEAST ONE LOW-PRESSURE DISCHARGE LAMP AND OPERATING DEVICE FOR AT LEAST ONE LOW-PRESSURE DISCHARGE LAMP

I. TECHNICAL FIELD

The invention relates to a method for operating at least one low-pressure discharge lamp using an inverter, during the operation of said at least one low-pressure discharge lamp the occurrence of a rectifier effect in the at least one low-pressure discharge lamp being monitored in order to determine the end of its life, and an operating device for at least one low-pressure discharge lamp.

II. BACKGROUND ART

An operating method such as this is disclosed, for example, in the international patent application having the publication number WO 99/56506. This document describes the operation of a low-pressure discharge lamp using a circuit arrangement which has a half-bridge inverter having a load circuit connected to it, in which the connections for the lamp are arranged. In order to detect the occurrence of the rectifier effect in the low-pressure discharge lamp, the voltage drop across the half-bridge capacitor is monitored and, when a predetermined upper limit value is overshot or a predetermined lower limit value is undershot, a disconnecting apparatus for the half-bridge inverter is activated.

III. DISCLOSURE OF THE INVENTION

It is the object of the invention to provide an operating method for at least one low-pressure discharge lamp which makes it possible to reliably detect the rectifier effect in the at least one low-pressure discharge lamp and, in particular, prevents the operating device from being disconnected as a result of an incorrect detection of the rectifier effect. In addition, it is the object of the invention to provide an operating device for at least one low-pressure discharge lamp for carrying out this method.

This object is achieved by a method for operating at least one low-pressure discharge lamp using an inverter, during the operation of said at least one low-pressure discharge lamp the occurrence of a rectifier effect in the at least one low-pressure discharge lamp being monitored in order to determine the end of its life, wherein for the purpose of monitoring said rectifier effect of said at least one low-pressure discharge lamp, the DC voltage drop across the electrical connections of said at least one low-pressure discharge lamp and the current through the at least one low-pressure discharge lamp or a variable proportional thereto are evaluated. Particularly advantageous refinements of the invention are described in the dependent patent claims.

The method according to the invention for operating at least one low-pressure discharge lamp using an inverter is characterized in that, for the purpose of monitoring the occurrence of the rectifier effect in the at least one low-pressure discharge lamp, the DC voltage drop across the electrical connections of the at least one low-pressure discharge lamp and the current through the at least one low-pressure discharge lamp or a variable proportional thereto are evaluated in order to define from this a criterion for the presence of the rectifier effect in the at least one low-pressure discharge lamp and thus also a criterion for the at least one low-pressure discharge lamp reaching the end of its life. By monitoring and evaluating the abovementioned variables, the occurrence of the rectifier effect can be established with sufficient accuracy irrespective of the lamp used and of the present dimming setting. The method according to the invention increases the reliability of the system comprising the at least one low-pressure discharge lamp and the operating device, since the tolerance range for establishing the end of life of the at least one low-pressure discharge lamp can be specified more precisely by means of the abovementioned variables, and in this manner the operating device is prevented from being disconnected as a result of an incorrect detection of the rectifier effect.

In order to evaluate the abovementioned variables, the product of the current through the at least one low-pressure discharge lamp and the DC voltage drop across the electrical connections of the at least one low-pressure discharge lamp is advantageously compared with a predetermined power value, since this product directly gives a measure of the asymmetry of the emission behavior of the lamp electrodes, and the result gives a value for an electrical power which can be compared directly with the maximum permissible value which is specified in the supplement to the Standard IEC 61347-2-3 "Particular requirements for a.c. supplied electronic ballasts for fluorescent lamps" under Test 2 "Asymmetric Power Dissipation". This maximum value is 7.5 watts for T5 lamps and 5.0 watts for T4 lamps.

The comparison is continuously repeated throughout the lamp operation using updated values of the abovementioned variables in order to prevent the lamp electrodes from being overheated in the event of the occurrence of the rectifier effect. In order to make it possible to reliably detect the rectifier effect, and thus to prevent an accidental, single occurrence of the maximum permissible value being overshot resulting in the at least one low-pressure discharge lamp being disconnected, a counting operation is advantageously carried out as a function of the result of the comparison, and, in the event of a counter overflow or of an upper counter threshold being overshot, a status bit is set or reset. The state of the status bit is thus an indication as to whether the at least one low-pressure discharge lamp has already reached the end of its life.

The evaluation is advantageously carried out using a microcontroller in which a corresponding program for carrying out the comparisons has been implemented. In addition, the microcontroller may also take on the function of controlling the driver circuits for the transistor switches of the inverter. For evaluation purposes, the values, which are determined at different points in time in the lamp operation, for the difference between a predetermined power value and the product of the DC voltage drop across the electrical connections of the at least one low-pressure discharge lamp and the current through the at least one low-pressure discharge lamp or a variable proportional thereto are preferably totaled.

The current through the at least one low-pressure discharge lamp or the variable proportional thereto is advantageously determined by means of a resistor which, during a half-cycle of the current through the at least one low-pressure discharge lamp, for example during the positive half-cycle, is connected in series with the at least one low-pressure discharge lamp. The voltage drop across this resistor is used, preferably following smoothing by means of a low-pass filter connected downstream of the resistor, to determine the current through the at least one low-pressure discharge lamp. The voltage drop across the abovementioned resistor may also be used to regulate the brightness of the at least one low-pressure discharge lamp. The same measured values may therefore be evaluated, for example with the aid of a microcontroller, both for regulating the brightness and for detecting the end of life of the at least one low-pressure discharge lamp.

The operating device according to the invention for at least one low-pressure discharge lamp has the following features:

- a half-bridge inverter, to which a load circuit is connected, in which electrical connections for at least one low-pressure discharge lamp and at least one half-bridge capacitor are arranged,
- a first measuring apparatus for measuring a first voltage, which is proportional to the current through the at least one low-pressure discharge lamp,
- a second measuring apparatus for measuring a second voltage, which is proportional to the voltage drop across the at least one half-bridge capacitor,
- a third measuring apparatus for measuring a third voltage, which is proportional to the supply voltage of the half-bridge inverter, and
- an evaluation unit, which is connected to the outputs of the measuring apparatuses, comprises a program-controlled microcontroller, and serves the purpose of evaluating the first, second and third voltage and of controlling the half-bridge inverter as a function of the result of the evaluation.

The operating device described above makes it possible to carry out the operating method according to the invention.

IV. BRIEF DESCRIPTION OF THE DRAWINGS

Figure 2:
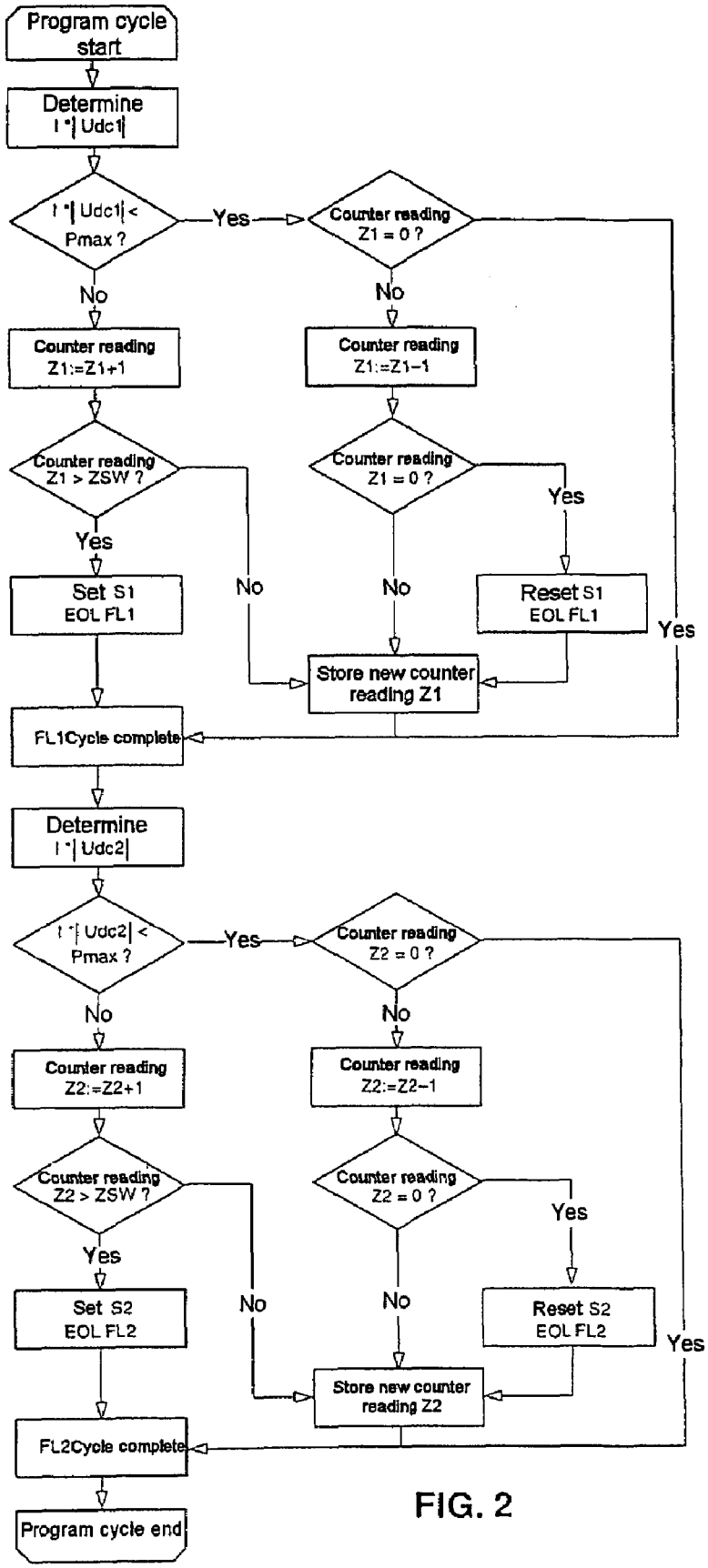

The invention is explained in more detail below using a preferred exemplary embodiment. In the drawing:

FIG. 1 shows a schematic illustration of a circuit diagram of the circuit arrangement of the operating device according to the invention for carrying out the operating method according to the invention, and FIG. 2 shows a flowchart of the operating method according to the invention.

V. BEST MODE FOR CARRYING OUT THE INVENTION

The operating device according to the invention which is depicted schematically in FIG. 1 is an electronic ballast for operating two low-pressure discharge lamps connected in parallel, in particular T5 fluorescent lamps FL1, FL2. In particular, this ballast also makes it possible to regulate the brightness of the fluorescent lamps FL1, FL2.

The ballast has two system voltage connections 1, 2, a downstream system voltage rectifier GL, which also comprises a filter circuit and, if desired, a step-up converter, and at whose voltage output the supply voltage for the downstream half-bridge inverter is provided. The half-bridge inverter has two half-bridge transistors T1, T2, and a load circuit in the form of a series resonant circuit is connected at the center tap M of these half-bridge transistors T1, T2, said load circuit comprising the resonant inductor L1 and the resonant capacitor C1. Arranged in parallel with the resonant capacitor C1 are two fluorescent lamps FL1, FL2, connected in parallel. This parallel circuit has two half-bridge capacitors C2, C3 which are each arranged in series with one of the fluorescent lamps FL1 and FL2, respectively. In addition, each branch of the parallel circuit has a winding N1 and N2, respectively, of a balanced-to-unbalanced transformer L2, which serves the purpose of balancing the lamp currents in the two branches. The connection A2, which is at a high potential, of the first half-bridge capacitor C2 is connected via the winding N2 of the transformer L2, the electrode E2 of the first fluorescent lamp FL1 and the resistor R1 to the positive DC voltage output of the system voltage rectifier GL. In analogy to this, the connection A3, which is at a high potential, of the second half-bridge capacitor C3 is connected via the winding N1 of the transformer L2, the electrode E4 of the second fluorescent lamp FL2 and the resistor R2 to the positive DC voltage output of the system voltage rectifier GL. The connections, which are at a low potential, of the half-bridge capacitors C2, C3 are each connected to the negative DC voltage output of the system voltage rectifier GL and to the ground potential. The connection A1 of the resonant capacitor C1 is connected to the electrode E1 of the first fluorescent lamp FL1 and to the electrode E3 of the second fluorescent lamp, and is connected, via the resonant inductor L1, to the center tap M of the half-bridge inverter. The other connection of the resonant capacitor C1 is connected to the negative DC voltage output of the system voltage rectifier GL and to the ground potential. In addition, the connection A1 is connected via the electrode E1 and the resistor R3 to the positive DC voltage output of the system voltage rectifier GL. The heating apparatus H which is depicted only schematically in FIG. 1 is inductively coupled to all electrodes E1, E2, E3, E4 of the two fluorescent lamps FL1, FL2 and serves the purpose of heating the lamp electrodes prior to the gas discharge being ignited or else during the dimming operation of the lamps. Details of this heating apparatus H are described, by way of example, in the laid-open specification EP 0 748 146 A1. The resistors R0, R1, R2 and R3 serve the purpose of setting the potentials at the taps A1, A2 and A3. In particular, the corresponding electrical voltages can be built up across the capacitors C1, C2 and C3 by means of the abovementioned resistors directly after the operating device has been connected and prior to ignition of the gas discharge in the lamps FL1, FL2.

The half-bridge transistors T1, T2 are controlled with the aid of the program-controlled microcontroller MC and the driver circuits TR for the transistors T1, T2. By alternately switching the transistors T1, T2, the center tap M is alternately connected to the negative and the positive DC voltage output of the system voltage rectifier GL. Since the half-bridge capacitors C2, C3 are charged to half the supply voltage of the half-bridge inverter, during lamp operation a high-frequency alternating current, whose frequency is determined by the switching clock of the transistors T1, T2, flows between the taps M and A2 and A3, respectively. In order to ignite the gas discharge in the fluorescent lamps FL1, FL2, the switching clock of the half-bridge transistors T1, T2 is altered such that the frequency of the alternating current in the load circuit is close to the resonant frequency of the series resonant circuit L1, C1. This results in a sufficiently high voltage being generated across the resonant capacitor C1 in order to ignite the gas discharge in the fluorescent lamps FL1, FL2. Once the gas discharge in the fluorescent lamps FL1, FL2 has been ignited, the series resonant circuit L1, C1 is damped by the parallel circuit of the fluorescent lamps FL1, FL2. The brightness of the fluorescent lamps FL1, FL2 is likewise regulated by altering the frequency of the alternating current in the load circuit and in the parallel circuit of the fluorescent lamps FL1, FL2.

The resistor R14, the two rectifier diodes D3, D4 and the low-pass filter R15, C10 serve the purpose of measuring the current I through the parallel circuit of the lamps FL1, FL2. Owing to the polarity of the two diodes D3, D4, a voltage is measured across the resistor R14 which is proportional to the positive half-cycle of the current I. A value U1 for this voltage which has been averaged over one or more half-cycles is supplied to the connection A11 of the microcontroller MC by means of the downstream low-pass filter R15, C10 for evaluation purposes. The voltage U1 averaged over time is therefore proportional to the average value $I_+$ over time of the positive half-cycle of the current I through the parallel-connected lamps FL1, FL2. The voltage U1 detected across the connection A11 is also used for regulating the brightness of the two fluorescent lamps FL1, FL2.

The voltage divider R6, R7 having the capacitor C5 which is connected in parallel with the resistor R7 is arranged in parallel with the DC voltage output of the system voltage rectifier GL. At the tap A6 between the resistors R6, R7, which is connected to the corresponding connection A6 of the microcontroller MC, the voltage U2 is measured which is proportional to the supply voltage of the half-bridge inverter. The voltage divider R8, R9 having the capacitor C6 which is connected in parallel with the resistor R9 is arranged in parallel with the half-bridge capacitor C3. At the tap A7 between the resistors R8, R9, which is connected to the corresponding connection A7 of the microcontroller MC, the voltage U3 is measured which is proportional to the voltage drop across the half-bridge capacitor C3. In analogy to this, the voltage divider R10, R11 having the capacitor C7 which is connected in parallel with the resistor R11 is arranged in parallel with the half-bridge capacitor C2. At the tap A8 between the resistors R10, R11, which is connected to the corresponding connection A8 of the microcontroller MC, the voltage U4 is measured which is proportional to the voltage drop across the half-bridge capacitor C2.

The voltages U1 to U4 present across the connections A6, A7, A8 and A11 are converted into digital values by means of an analog-to-digital converter and evaluated by the microcontroller MC with the aid of a program implemented in the microcontroller in order to provide for the brightness regulation of the fluorescent lamps FL1, FL2 and for the detection of the end of life of the lamps FL1, FL2 by means of the driver circuit TR by correspondingly controlling the half-bridge transistors T1, T2. The end of life of the lamps FL1, FL2 is established by monitoring the occurrence of the rectifier effect in the fluorescent lamps FL1, FL2. For this purpose, the DC voltage drop $U_{dc1}$ and $U_{dc2}$, respectively, across the electrical connections of the fluorescent lamps FL1, FL2 and the current through the fluorescent lamps FL1, FL2, i.e. the total current I through the parallel circuit of the lamps FL1, FL2, are evaluated using the microcontroller MC. The average value $I_+$ over the positive half-cycle of the current I is calculated from the voltage U1 and the resistance R14 as:

$$I_+ = \frac{U1}{R14} \tag{1}$$

The DC voltage drop $U_{dc1}$ across the electrical connections of the fluorescent lamp FL1 is calculated from the difference between half the supply voltage of the half-bridge inverter and the voltage drop across the half-bridge capacitor C2 and can therefore be determined from the voltages U2 and U4.

$$U_{dc1} = \frac{1}{2} \cdot U2 \cdot \frac{R6 + R7}{R7} - U4 \cdot \frac{R10 + R11}{R11} \tag{2}$$

In analogy to this, the DC voltage drop $U_{dc2}$ across the electrical connections of the fluorescent lamp FL2 is calculated from the difference between half the supply voltage of the half-bridge inverter and the voltage drop across the half-bridge capacitor C3 and can therefore be determined from the voltages U2 and U3.

$$U_{dc2} = \frac{1}{2} \cdot U2 \cdot \frac{R6 + R7}{R7} - U3 \cdot \frac{R8 + R9}{R9} \tag{3}$$

Using the abovementioned variables $I_+$ and $U_{dc1}$, and $U_{dc2}$, respectively, the power P1 and P2, respectively, for the two fluorescent lamps FL1 and FL2, respectively, can be calculated using the formula $$P1 = I_+ \cdot |U_{dc1}| \cdot p \text{ and } P2 = I_+ \cdot |U_{dc2}| \cdot p \tag{4a), (4b),}$$

the correction factor p depending on the waveform and being given by the form factor k and the duty ratio τ as:

$$p = \frac{k^2}{\tau} \tag{5}$$

For a sinusoidal signal having a duty ratio of 0.5, the correction factor p has the value 1.11. The values for the powers P1 and P2, respectively, can be compared directly with the maximum permissible limit value $P_{max}$ of 7.5 watts for the lamp power in T5 lamps, given in "Test 2: Asymmetric Power Dissipation" of the supplement to the Standard IEC 61347-2-3, in order to monitor the end of the life of the two fluorescent lamps FL1, FL2. This comparison is repeated cyclically for the two lamps FL1, FL2 during lamp operation by means of the microcontroller MC.

In order in the comparison evaluation in the microcontroller to dispense with the second multiplication in the formulas (4a, 4b), the correction factor p is included in the comparison value $P_{max}$, and this value is stored in the non-volatile memory. During continuous operation, this stored value is then compared cyclically with the product of $I_+$ and the value for $U_{dc1}$ and $U_{dc2}$, respectively.

The method for monitoring the end of life of the two T5 fluorescent lamps FL1, FL2 is described in more detail below with reference to the flowchart depicted in FIG. 2.

At the beginning of the method, which is carried out cyclically, the powers P1 and P2 are calculated using the program implemented in the microcontroller MC from the measured values for the variables U1, U2 and U3 and U4, respectively, which are updated during each cycle of the method, in accordance with the above formulas in succession for the two lamps FL1 and FL2 and are each compared with the maximum permissible power $P_{max}$. If, respectively in each particular case, the power P1 or P2 is smaller than the maximum permissible power $P_{max}$ and the counter reading of the count variables Z1 or Z2 for the lamps FL1 or FL2 is equal to zero, the present cycle for the lamp FL1 or FL2 is abandoned. If the power P1 or P2 is smaller than the maximum permissible power $P_{max}$ and the counter reading of the count variables Z1 or Z2 for the lamp FL1 or FL2 is greater than zero, the counter Z1 or Z2 is reduced by the value 1. If, subsequently, the counter reading is equal to zero, the status bit S1 or S2 for reaching the end of life of the lamp FL1 or FL2 is reset, otherwise the new counter reading Z1 or Z2 is stored and the present cycle for the lamp FL1 or FL2 is abandoned. If the power P1 or P2 is, however, not smaller than the maximum permissible power $P_{max}$, the counter Z1 or Z2 is increased by 1. If, subsequently, the value of the counter Z1 or Z2 overshoots the upper counter threshold ZSW, then the status bit S1 or S2 is set, i.e. the lamp FL1 or FL2 has reached the end of its life. If the value of the counter Z1 or Z2 is not greater than the upper counter threshold ZSW, then the new counter reading Z1 or Z2 is stored, and, subsequently, the present cycle for the lamp FL1 or FL2 is abandoned. The value of the upper counter threshold ZSW may be predetermined.

In the event that the status bit S1 or the status bit S2 is set, the operating device is disconnected.

The invention is not limited to the exemplary embodiment described in more detail above. For example, the lamps FL1, FL2 may also be interrogated alternately instead of successively in the same cycle. In addition, the counter readings Z1, Z2 may be increased or decreased by a value greater than 1 if the permissible limit value is overshot or undershot by a high value. Instead of the operating device or the lamps FL1, FL2 being disconnected in the event of the permissible maximum limit value being overshot, it is also possible for the lamps FL1, FL2 to be operated at a considerably reduced power until the permissible limit value is undershot again on a permanent basis.

What is claimed is:

1. An operating device for at least one low-pressure discharge lamp, comprising:

a voltage rectifier (GL) having connections (1,2) for receiving a system voltage and operable to provide a supply voltage between a positive DC voltage output (+) and negative DC voltage output (−), wherein the negative DC voltage output (−) is coupled to a circuit ground;

a half-bridge inverter (T1,T2,TR) coupled to the voltage rectifier and operable to receive the supply voltage from the voltage rectifier, the inverter including a first transistor (T1), a second transistor (T2), and a driver circuit (TR) for alternately switching the first and second transistors, wherein the inverter further includes a disconnecting apparatus that is activated in response to occurrence of a rectifier effect in the at least one low-pressure discharge lamp (FL1,FL2);

a load circuit (L1,C1,C2,C3) coupled to the inverter and the at least one low-pressure discharge lamp (FL1, FL2), the load circuit comprising a resonant inductor (L1), a resonant capacitor (C1), a first half-bridge capacitor (C2), and a second half-bridge capacitor (C3), the load circuit (L1,C1,C2,C3) being operable to deliver a current to the at least one low-pressure discharge lamp (FL1,FL2), the current including positive half-cycles and negative half-cycles;

an evaluation unit (MC) coupled to the driver circuit (TR) of the inverter, the microcontroller including first, second, third, and fourth inputs (A6,A7,A8,A11);

a first sub-circuit (R6,R7,C5) coupled between the positive DC voltage output (+) of the voltage rectifier (GL) and the first input (A6) of the evaluation unit (MC), the first sub-circuit being operable to provide a first voltage signal to the first input (A6) of the evaluation unit (MC), wherein the first voltage signal is proportional to the supply voltage;

a second sub-circuit (R8,R9,C6) coupled between the second half-bridge capacitor (C3) and the second input (A7) of the evaluation unit (MC), the second sub-circuit being operable to provide a second voltage signal to the second input (A7) of the evaluation unit (MC), wherein the second voltage signal is proportional to a voltage across the second half-bridge capacitor (C3);

a third sub-circuit (R10,R11,C7) coupled between the first half-bridge capacitor (C2) and the third input (A8) of the evaluation unit (MC), the third sub-circuit being operable to provide a third voltage signal to the third input (A8) of the evaluation unit (MC), wherein the third voltage signal is proportional to a voltage across the first half-bridge capacitor (C2);

a fourth sub-circuit (D3,D4,R14,R15,C10) coupled between the half-bridge capacitors (C2,C3) and the negative DC voltage output (−) of the voltage rectifier (GL), the fourth sub-circuit being operable to provide a fourth voltage signal to the fourth output (A11) of the evaluation unit (MC), wherein the fourth voltage signal is proportional to an average value of the positive half-cycles of the current through the at least one low-pressure discharge lamp; and wherein the evaluation unit (MC) is operable: (i) to detect, by way of the first, second, third, and fourth voltage signals, occurrence of a rectifier effect in the at least one low-pressure discharge lamp; and (ii) in response to occurrence of a rectifier effect in the at least one low-pressure discharge lamp, to activate the disconnecting apparatus of the inverter.

2. The operating device of claim 1, wherein the evaluation unit comprises a microcontroller (MC).

3. The operating device of claim 1, wherein the first sub-circuit comprises:

a first resistor (R6) coupled between the positive DC voltage output (+) of the voltage rectifier (GL) and the first input (A6) of the evaluation unit (MC);

a second resistor (R7) coupled between the first input (A6) of the evaluation unit (MC) and circuit ground; and a capacitor (C5) coupled between the first input (A6) of the evaluation unit (MC) and circuit ground.

4. The operating device of claim 1, wherein the second sub-circuit comprises:

a first resistor (R8) coupled between the second half-bridge capacitor (C3) and the second input (A7) of the evaluation unit (MC);

a second resistor (R9) coupled between the second input (A7) of the evaluation unit (MC) and circuit ground; and a capacitor (C6) coupled between the second input (A7) of the evaluation unit (MC) and circuit ground.

5. The operating device of claim 1, wherein the third sub-circuit comprises:

a first resistor (R10) coupled between the first half-bridge capacitor (C2) and the third input (A8) of the evaluation unit (MC);

a second resistor (R11) coupled between the third input (A8) of the evaluation unit (MC) and circuit ground; and a capacitor (C7) coupled between the third input (A8) of the evaluation unit (MC) and circuit ground.

6. The operating device of claim 1, wherein the fourth sub-circuit comprises:

a first diode (D3) coupled between the first and second half-bridge capacitors (C2,C3) and the negative DC voltage output (−) of the voltage rectifier (GL);

a series combination of a first resistor (R14) and a second resistor (R15), the series combination being coupled between the negative DC voltage output (−) of the voltage rectifier (GL) and the fourth input (A11) of the evaluation unit (MC);

a second diode (D4) coupled between the first and second half-bridge capacitors (C2,C3) and a junction of the first resistor (R14) and the second resistor (R5); and a capacitor (C10) coupled between the fourth input (A11) of the evaluation unit (MC) and circuit ground.

* * * * *